US010285467B2

(12) United States Patent
Pianta

(10) Patent No.: US 10,285,467 B2
(45) Date of Patent: May 14, 2019

(54) FOOTWEAR ORNAMENTATION ASSEMBLY, ORNAMENTATION INSERT AND RELATED METHODS

(71) Applicant: Elisabetta Pianta, N. Bay Village, FL (US)

(72) Inventor: Elisabetta Pianta, N. Bay Village, FL (US)

( * ) Notice: Subject to any disclaimer, the term of this patent is extended or adjusted under 35 U.S.C. 154(b) by 0 days.

(21) Appl. No.: 15/098,878

(22) Filed: Apr. 14, 2016

(65) Prior Publication Data

US 2017/0164682 A1 Jun. 15, 2017

Related U.S. Application Data

(60) Provisional application No. 62/147,037, filed on Apr. 14, 2015.

(51) Int. Cl.

| | |
|---|---|
| ***A43B 3/24*** | (2006.01) |
| ***A43B 3/12*** | (2006.01) |
| ***A43B 3/00*** | (2006.01) |
| ***A43B 23/24*** | (2006.01) |
| ***A43B 3/10*** | (2006.01) |
| ***A43B 17/02*** | (2006.01) |

(52) U.S. Cl.

CPC ..... *A43B 3/12* (2013.01); *A43B 3/0078* (2013.01); *A43B 3/108* (2013.01); *A43B 3/128* (2013.01); *A43B 3/24* (2013.01); *A43B 3/246* (2013.01); *A43B 17/023* (2013.01); *A43B 23/24* (2013.01)

(58) Field of Classification Search

CPC ..... A43B 3/0078; A43B 3/12; A43B 3/24; A43B 23/24

USPC ..... 36/11.5, 15, 100, 101, 136

See application file for complete search history.

(56) References Cited

U.S. PATENT DOCUMENTS

| | | | | |
|---|---|---|---|---|
| 2,112,761 A * | 3/1938 | Buehner | A43B 3/122 | 36/11.5 |
| 2,651,117 A * | 9/1953 | Harris | A43B 3/28 | 36/11.5 |
| 2,871,602 A * | 2/1959 | Uldall | A43B 3/0078 | 36/1 |
| 4,020,569 A * | 5/1977 | Fukuoka | A43B 1/0045 | 36/11.5 |
| 4,697,362 A * | 10/1987 | Wasserman | A43B 3/0078 | 36/136 |

(Continued)

OTHER PUBLICATIONS

PCT International Searching Authority: International Search Report and Written Opinion dated Jul. 17, 2017; entire document.

*Primary Examiner* — Marie D Bays
(74) *Attorney, Agent, or Firm* — Allen Dyer Doppelt & Gilchrist

(57) ABSTRACT

A footwear ornamentation assembly includes at least one insert and a plurality of design members that can be mounted on the insert or a flip-flop for decoration purposes. The at least one insert is releasably affixed on top of a flip-flop sole. The plurality of design members present different appearances. A method for decorating a flip-flop using the flip-flop ornamentation assembly includes selecting the at least one insert from a plurality of inserts, affixing the selected insert to a top of the flip-flop sole, selecting one or more design members from the plurality of design members, and mounting the selected one or more design members to the at least one of the selected insert and the flip-flop.

5 Claims, 7 Drawing Sheets

(56) References Cited

U.S. PATENT DOCUMENTS 4,712,319 A * 12/1987 Goria ..... A43B 1/0036 359/518
4,742,625 A * 5/1988 Sydor ..... A43B 17/18 36/11.5
4,813,162 A * 3/1989 Harris ..... A43B 3/108 36/11.5
4,887,369 A * 12/1989 Bailey ..... A43B 13/36 36/101
5,544,430 A * 8/1996 Jacko ..... A43B 3/16 36/100
5,992,058 A * 11/1999 Jneid ..... A43B 3/122 36/100
6,092,311 A * 7/2000 MacNamara ..... A43B 1/0036 36/100
6,442,870 B1 * 9/2002 Tsai ..... A43B 3/103 36/100
6,769,204 B1 * 8/2004 Phillips ..... A43B 1/0081 36/100
6,928,754 B2 * 8/2005 Cambronero ..... A43B 3/122 36/100
7,200,959 B2 * 4/2007 Spann ..... A43B 3/0078 36/11.5
7,272,899 B1 * 9/2007 Marak ..... A43B 3/122 36/101
7,398,607 B1 * 7/2008 Garcia ..... A43B 1/0072 36/101
7,614,126 B2 * 11/2009 Gerhardt ..... A43B 3/126 24/712
7,748,145 B2 * 7/2010 Jones ..... A43B 1/0027 36/136
7,891,117 B2 * 2/2011 Sack ..... A43B 3/0078 36/1
8,387,284 B2 3/2013 Baum
8,819,962 B2 * 9/2014 Candella ..... A43B 1/0045 36/11.5
2002/0174569 A1 * 11/2002 Tsai ..... A43B 3/103 36/101
2003/0200675 A1 10/2003 Gross
2005/0016028 A1 * 1/2005 Safdeye ..... A43B 3/0078 36/132
2006/0048408 A1 * 3/2006 Spann ..... A43B 3/0078 36/11.5
2008/0022558 A1 * 1/2008 Kaufer ..... A43B 3/0031 36/100
2009/0025259 A1 * 1/2009 Sack ..... A43B 23/24 36/136
2009/0193684 A1 * 8/2009 Diamond ..... A43B 1/0081 36/101
2010/0107446 A1 * 5/2010 Peet ..... A43B 3/0078 36/100
2012/0186109 A1 * 7/2012 Vanderbeek ..... A43B 3/0078 36/136
2012/0233890 A1 9/2012 Masters
2012/0234042 A1 * 9/2012 Chase ..... A43B 1/0054 63/1.18
2013/0118032 A1 * 5/2013 Raji ..... A43B 1/0027 36/100
2013/0174327 A1 7/2013 Baum
2014/0298686 A1 10/2014 Baum
2014/0360054 A1 * 12/2014 Leslie ..... A43B 1/0054 36/136
2015/0113833 A1 * 4/2015 Boncutter ..... A43B 23/24 36/136
2015/0113835 A1 * 4/2015 Rosenberger ..... A43B 1/0081 36/136
2015/0223568 A1 * 8/2015 Ortner ..... A43B 23/24 36/48
2016/0015117 A1 * 1/2016 Kizer ..... A43B 3/122 36/11.5
2016/0015130 A1 * 1/2016 Knox ..... A43B 3/0078 36/136
2016/0157559 A1 * 6/2016 Schwartz ..... A43B 23/24 36/136

* cited by examiner

FOOTWEAR ORNAMENTATION ASSEMBLY, ORNAMENTATION INSERT AND RELATED METHODS

CROSS-REFERENCE TO RELATED APPLICATION

The present application claims the benefit of U.S. Provisional Patent Application Ser. No. 62/147,037, filed on Apr. 14, 2015, the contents of which are herein incorporated by reference in their entirety.

FIELD OF THE INVENTION

The present invention relates to the ornamenting of footwear, and more particularly, to flip-flop ornamentation assemblies.

BACKGROUND OF THE INVENTION

Historically, to match a variety of outfits, or express a variety of moods, an individual acquires several pairs of footwear. Naturally, this can become very expensive, and also result in storage problems. One way individuals will try to alter the appearance of footwear is to decorate shoes, sandals or the like after purchase with additional designs and/or ornaments. For example, to decorate flip-flops, designs or ornaments are permanently printed or attached to the flip-flops. However, since a flip-flop typically includes only a sole with a Y-shaped strap attached thereto, flip-flop decorating options are often limited and difficult to implement. While there are some detachable ornamentation assemblies for various flip-flops and other sandals and footwear, further improvements are possible.

SUMMARY OF THE INVENTION

In view of the foregoing, it is an object of the present invention to provide an improved footwear ornamentation assembly and related method of use. The footwear ornamentation assembly includes an insert and a plurality of design members that can be mounted thereto for decoration. The insert is releasably affixed on top of a sole.

A method for decorating footwear using the flip-flop ornamentation assembly includes selecting one insert from the plurality of inserts, affixing the selected insert to a top of the flip-flop sole, selecting one or more design members from the plurality of design members, and mounting the selected one or more design members to the at least one of the selected insert and the flip-flop.

These and other objects, aspects and advantages of the present invention will be better understood in view of the drawing and following detailed description of preferred embodiments.

DETAILED DESCRIPTION OF PREFERRED EMBODIMENTS

Figure 1:
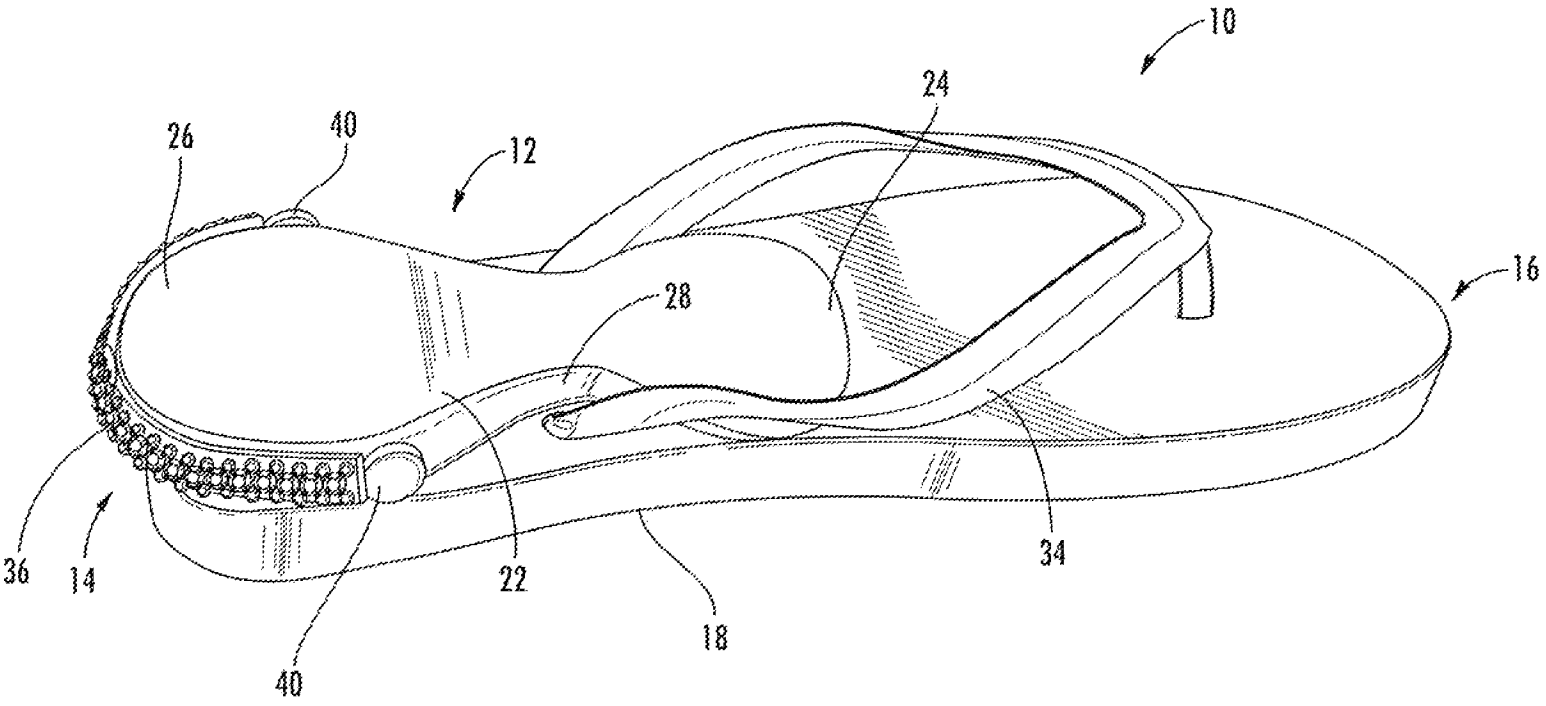
FIG. 1 is a perspective view of a footwear ornamentation assembly, including a flip-flop and an insert affixed on the top of a flip-flop sole, according to an embodiment of the present invention.
Figure 2:
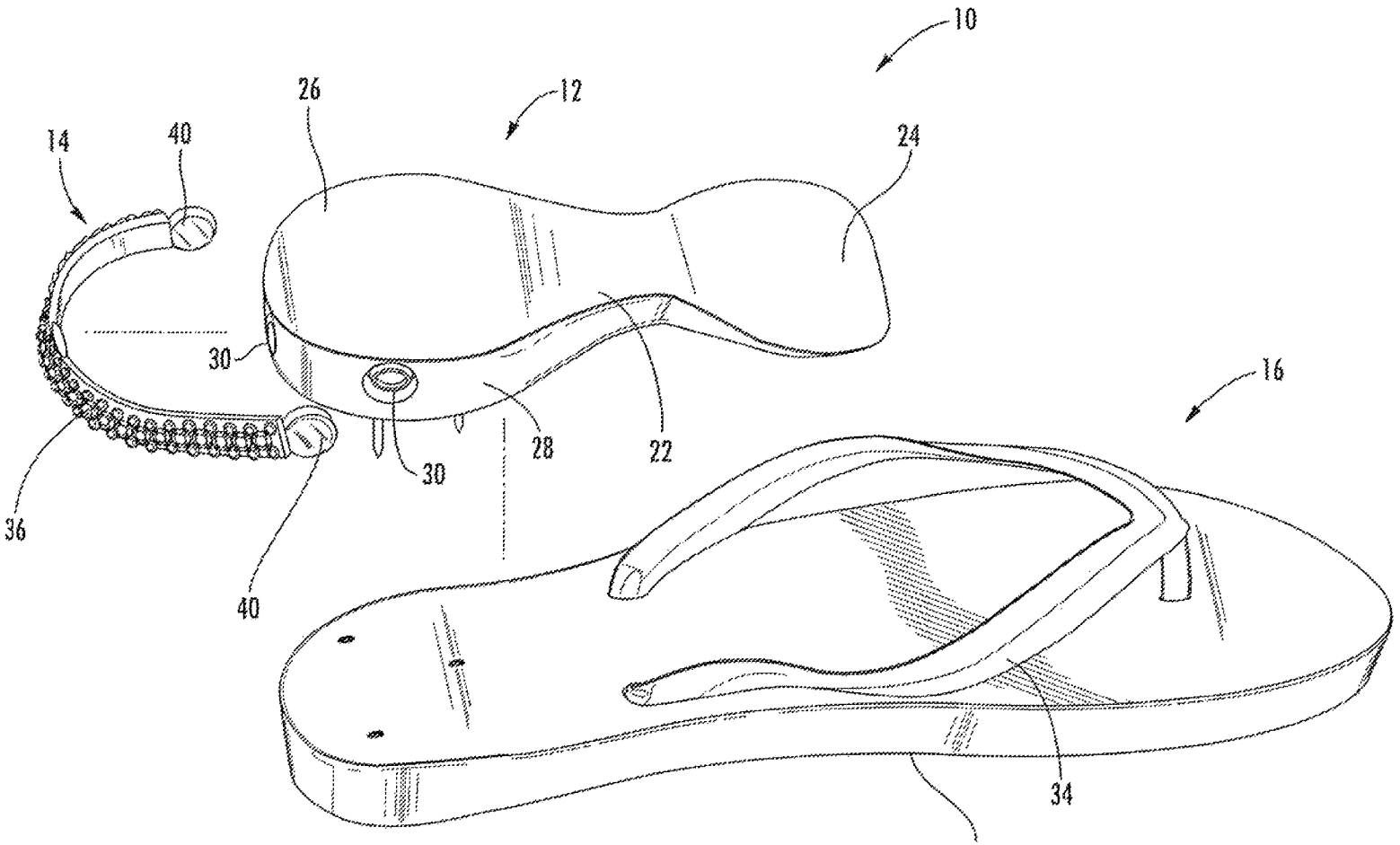
FIG. 2 is a exploded perspective view of the footwear ornamentation assembly of FIG. 1.
Figure 3:
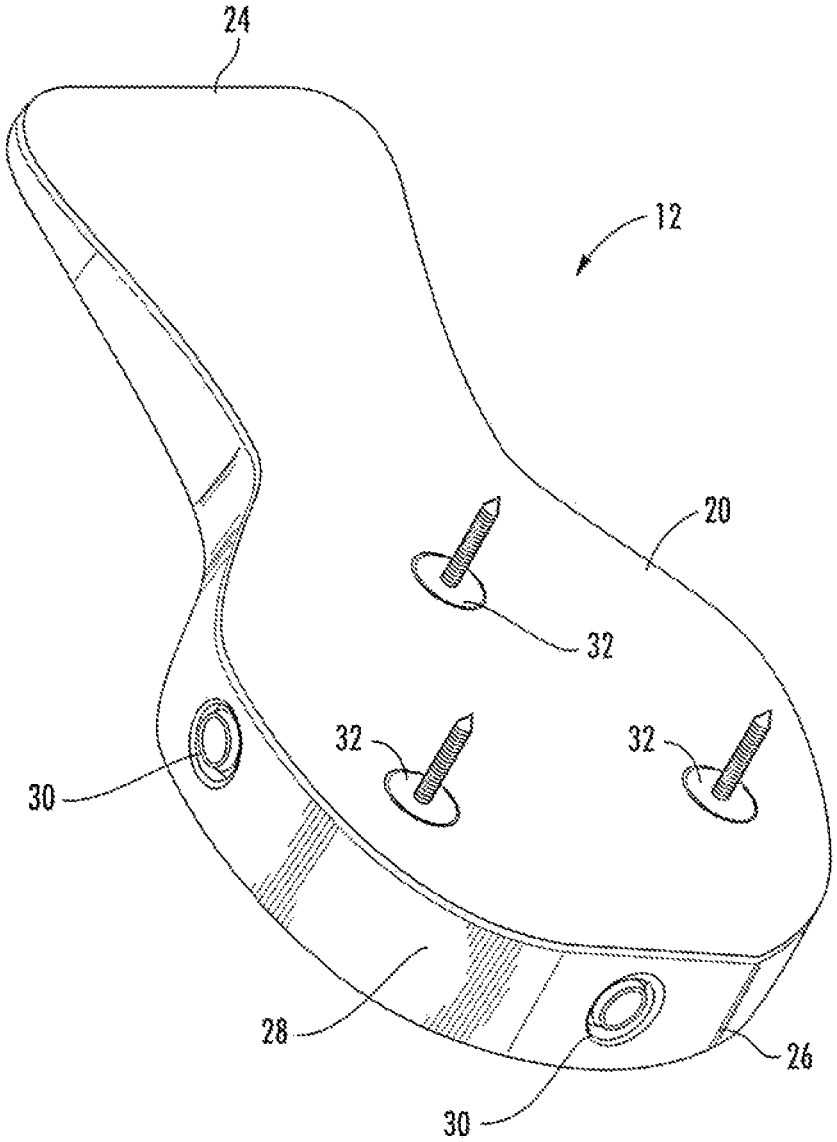
FIG. 3 is a perspective view of the insert of FIG. 1.

According to an embodiment of the present invention, referring to FIGS. 1-3, a footwear ornamentation assembly 10 includes at least one insert 12, a design member 14 releasably connected to the insert 12, and a flip-flop 16 carrying the insert 12 and connected design member 14. The insert 12 is preferably releasably affixed on top of a sole 18 of the flip-flop 16. An unornamented flip-flop 16 can be easily adapted for ornamentation by attachment of the insert 12 and subsequent attachment of the design member 14. Advantageously, a plurality of design members 14 and/or inserts 12 can be offered for interchangeable use, affording a virtually unlimited number of design options.

The insert 12 has a lower surface 20 facing flip-flop sole 18 and an upper surface 22 facing away therefrom extending between front and rear edges 24, 26. A sidewall 28 extends between the lower and upper surfaces 20, 22 and, in the area of the read edge 26, extends proximate to a periphery of a heel portion of the sole 18. A plurality of design fastener elements 30 face outwardly from the sidewall 28 for connection of the design member 14. Advantageously, at least three side fastener elements 30 are located thereon for secure, releasable connection of the design member 14. A plurality of sole fastener elements 32 extends from the lower surface 20 for connecting the insert 12 to the sole 18. Recesses are preferably pre-formed in the insert 12 to receive the fastener elements 30, 32.

Preferably, a thickness of the insert 12 between the lower and upper surfaces 20, 22 decreases from the rear edge 26 to the front edge 24, such that the insert 12 is generally wedge-shaped. In the embodiment of FIGS. 1-3, a width of the insert 12 also varies from the front and rear edges 24, 26, the width being constricted in the area of a rear attachment area of a strap 34 of the flip-flop 16 and then flaring outward forwardly thereof, giving the insert 12 an "hourglass" shape. For decorative purposes, designs or patterns may be printed on the insert 12, and the insert 12 is preferably made out of rubber or foam, although any material having suitable properties for a desired application, including strength, weight, rigidity, etc., could be used.

The design member 14 includes a strap 36 having a plurality of design fastener elements 40 attached thereto and complementary with the design fastener elements 30 of the insert 12. The strap 36 can be printed with decorative patterns and/or have a plurality of decorative elements attached thereto. Non-limiting examples include jewels (faux or real), glitter, letters, and shapes. The fastener elements 30, 40 allow design members 14 to be readily interchanged depending on the preference and mood of the wearer.

In the depicted embodiment, the fastener elements 30, 40 are complementary portions of snap fasteners, although the present invention is not necessarily limited thereto. Screw fasteners, tacks, magnets, hook and loop fasteners, and other known fasteners types could be employed instead of or in addition to snap fasteners. Likewise, the depicted sole fastener elements 32 are tacks, but other fastener types could be used for the fastener elements 32, as well.

In use, a wearer selects a pair of inserts 12 and attaches them via the sole fastener elements 32 to the flip-flop soles 18. The wearer then selects a design member 14, preferably from among a plurality of options, for attachment to each of the inserts 12. When the wearer wishes to alter the appearance of his or her flip-flops, the attached design members 14 are removed and others are installed in their place. Additionally, the inserts 12 could be replaced for an even more thorough change of appearance. If the wearer has multiple flip-flops or sandals, inserts 12 and/or design members 14 can be interchanged therebetween.

The foregoing embodiment is provided for illustrative and exemplary purposes; the present invention is not necessarily limited thereto. For instance, it is described above how different types of fasteners could be employed in lieu of the depicted snaps and tacks. In the following descriptions of alternate embodiments, similar elements are described using similar reference numbers (e.g., 10, 10A, 10B). Except as described, such similar elements can be arranged and function as described above.

Figure 4:
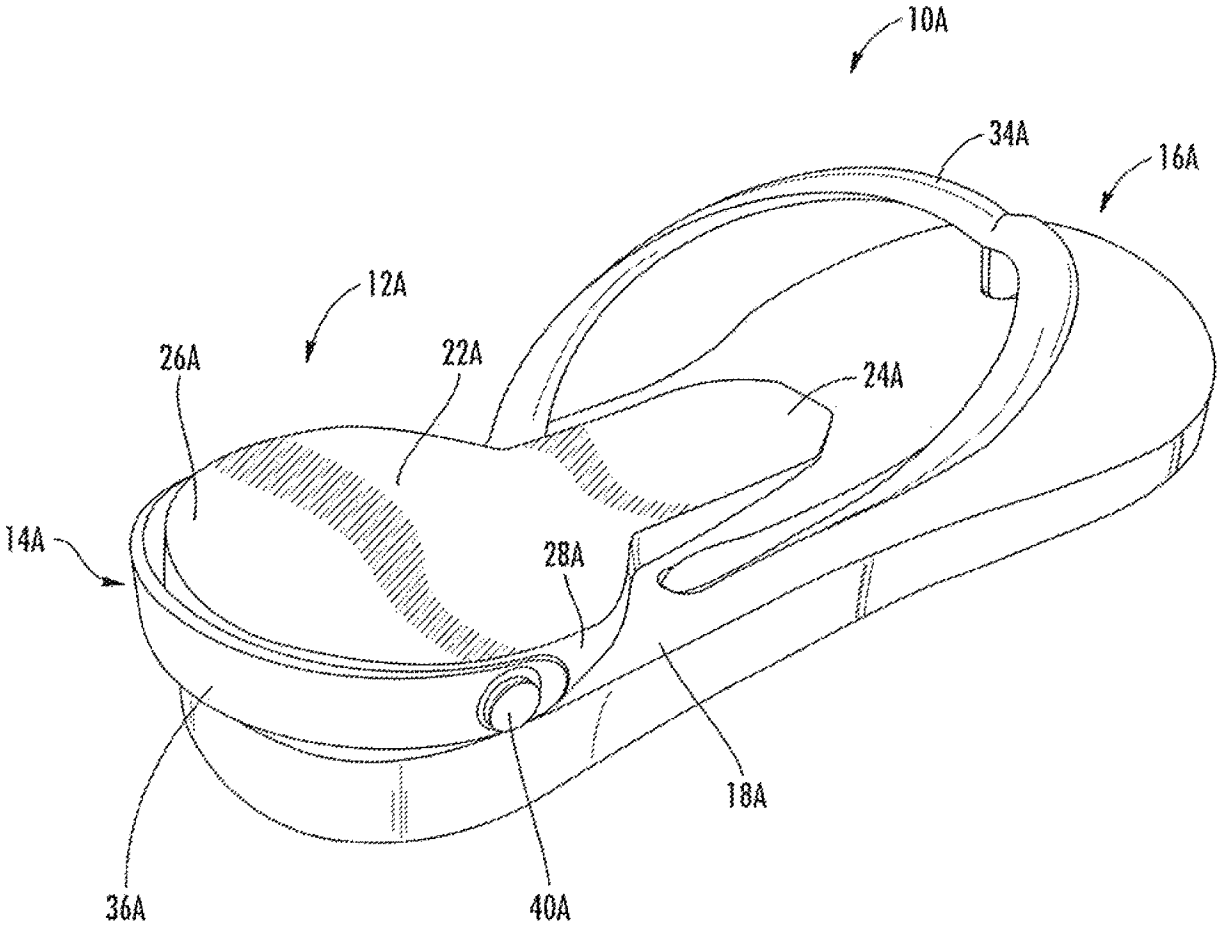
FIG. 4 is a perspective view of a footwear ornamentation assembly, including a flip-flop and an insert affixed on the top of a flip-flop sole, according to another embodiment of the present invention.

Referring to FIG. 4, according to another embodiment of the invention, a footwear ornamentation assembly 10A includes an insert 12A that has a keyhole shape rather than the hourglass shape of the insert 10. Such an alternate shape can be useful for flip-flops with other strap configurations, as well as other types of sandals or open-heeled footwear that may wholly or partially cover the front of the foot.

Figure 5:
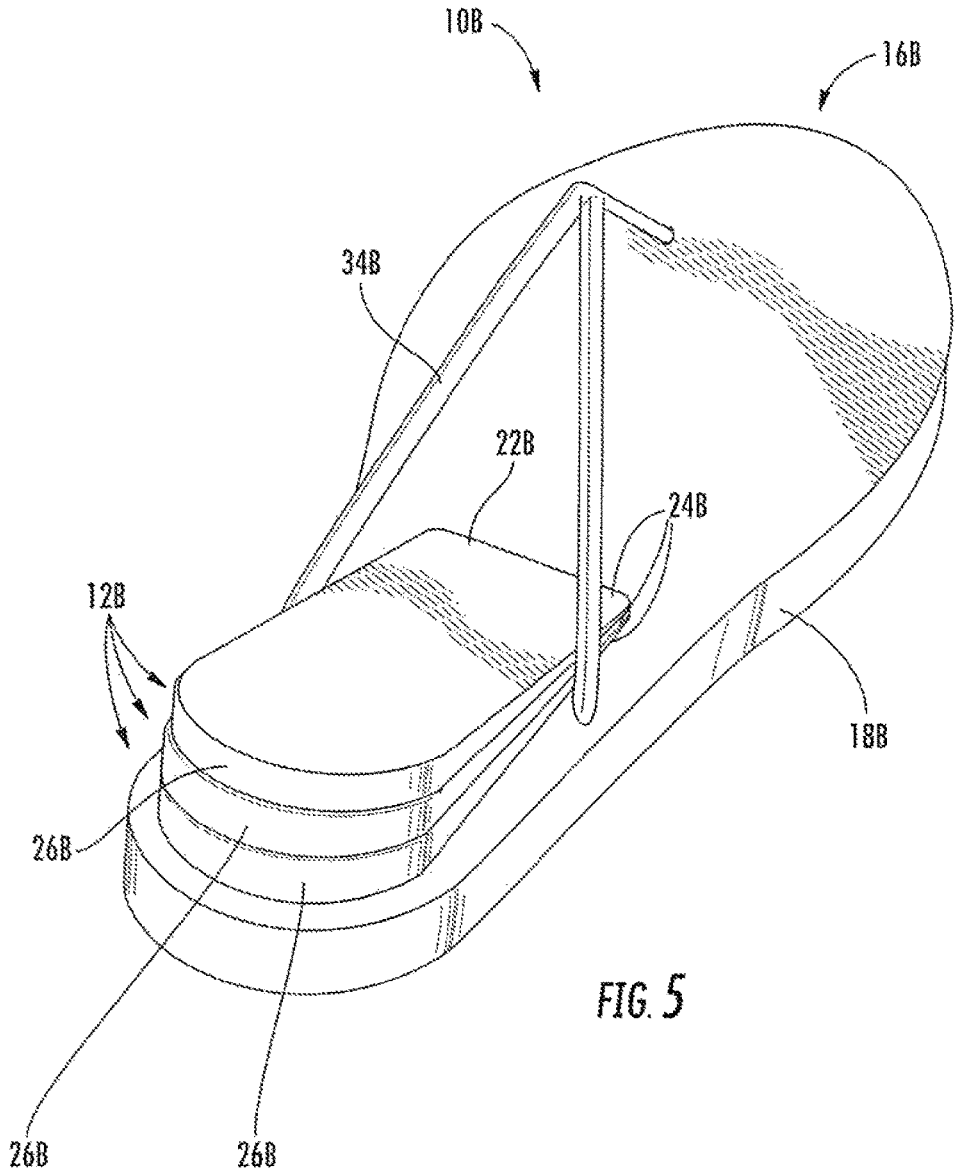
FIG. 5 is a perspective view of a footwear ornamentation assembly, including a flip-flop and a plurality of inserts affixed on the top of a flip-flop sole, according to a further embodiment of the present invention.

Referring to FIG. 5, in a further embodiment of the present invention, a footwear ornamentation assembly 10B includes a plurality of inserts 12B that are stacked up. Beyond adding decoration with multiple inserts 12B (which could incorporate different colors, patterns, etc.), the wearer's heal is also elevated. The inserts 12B also illustrate a further alternate shape, with a rounded heel but otherwise a near constant width between the front and rear edges 24A, 26A, although inserts of any shape could be used in a similar, stacked configuration. Additionally, the inserts 12B in FIG. 6 are not equipped with design fastener elements, but the same could also be included allowing attachment of design elements to one or more of the stacked inserts 12B.

Figure 6:
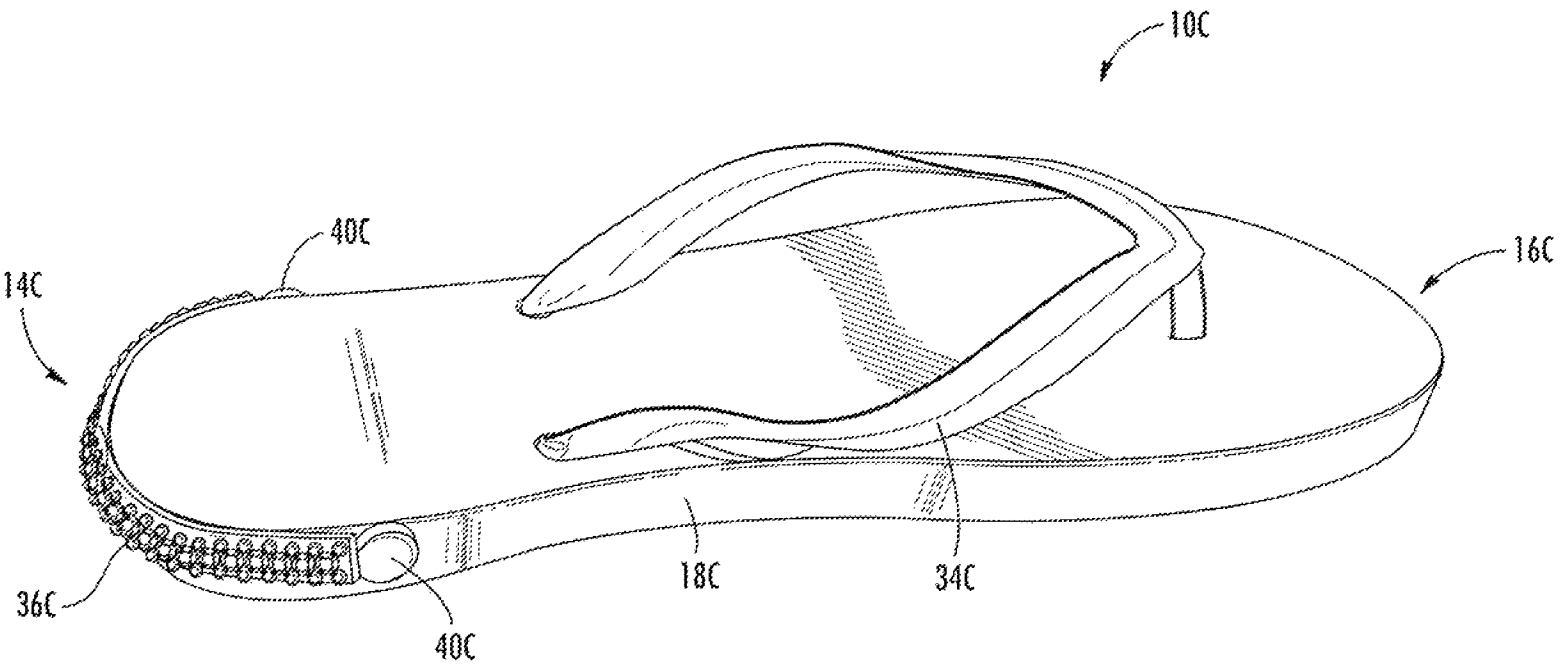
FIG. 6 is a perspective view of a footwear ornamentation assembly, according to another embodiment of the present invention.
Figure 7:
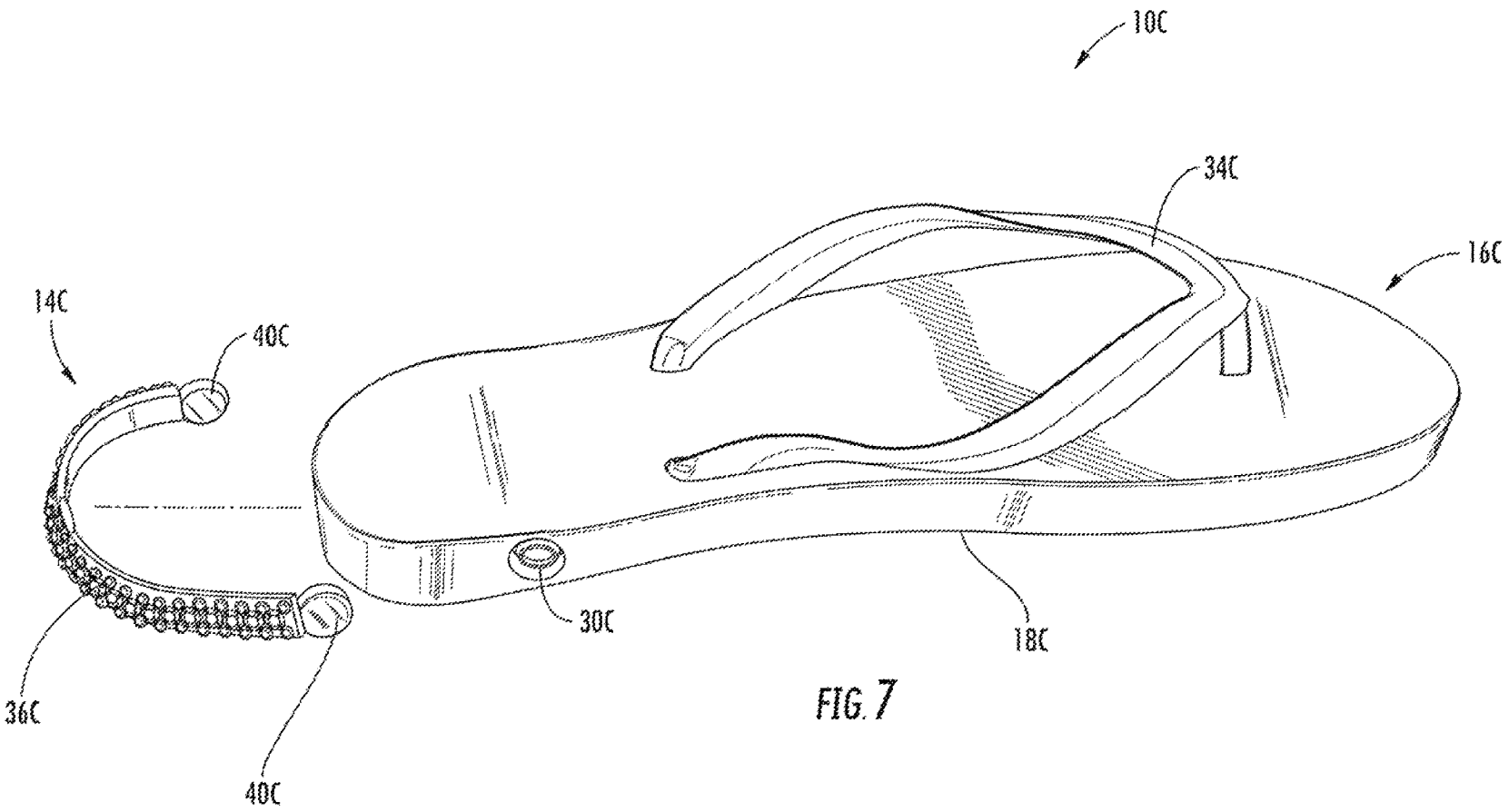
FIG. 7 is an exploded perspective view of the footwear ornamentation assembly of FIG. 6.

Referring to FIGS. 6 and 7, while the footwear ornamentation assemblies 10, 10A and 108 are particularly advantageous for use with footwear not already adapted to receive design elements 14, 14A, 14B, in another embodiment, a footwear ornamentation assembly 10C has fastener elements 40C located directly on the heel portion of the sole 18C of the flip-flop 16C or other footwear. This configuration allows design elements 14C to be attached directly to the sole 18C, and to be more readily attached to other parts of the sole 18C (e.g., the sides or toe area) and utilized on footwear lacking an open heel. Additionally, inserts could also be attached to the flip-flop 16C, giving further design flexibility and the ability to mount design elements 14C to both the sole 18C and to any such inserts.

The foregoing is not an exhaustive list of alternate embodiments; rather, those skilled in the art will appreciate that additional modifications, as well as adaptations for particular circumstances, will fall within the scope of the invention as herein shown and described and of the claims appended hereto.

What is claimed is:

1. A footwear ornamentation assembly comprising:

an open-heeled footwear article having a sole, the sole including top and bottom surfaces separated by a sidewall, the sidewall having left and right sides connected by a curved rear edge; and a first design member extending between first and second ends, the first and second ends releasably connected to the left and right sides of the sidewall via respective first and second fastener elements forming the first and second ends;

wherein the first design member extends along and adjacent to the curved rear edge of the sidewall, conforming to a curve thereof.

2. The footwear ornamentation assembly of claim 1, wherein the open-heeled footwear article is a sandal.

3. The footwear ornamentation assembly of claim 1, further comprising a second design member configured to be releasably connected to the side wall of the rear edge of the sole in place of the first design member, wherein the second design member is different in appearance from the first design member.

4. A method of using a footwear ornamentation assembly, the method comprising:

releasably connecting first and second fastener elements forming first and second ends of a first design member to left and right sides of a sidewall of a sole of a footwear article such that the first design member extends along and adjacent to a curved rear edge of the sidewall, conforming to a curve thereof; and removing the first design element from the sole and releasably connecting a second design member different in appearance from the first design element to the sole.

5. The method of claim 4, wherein the footwear article is open-heeled.

* * * * *